US006145153A

United States Patent [19]

Weihrauch

[11] Patent Number: 6,145,153

[45] Date of Patent: Nov. 14, 2000

[54] DENTAL HYGIENE DEVICE WITH REPLACEABLE CLEANING PART

[75] Inventor: Georg Weihrauch, Wald-Michelbach, Germany

[73] Assignee: Coronet-Werke GmbH, Wald-Michelbach, Germany

[21] Appl. No.: 09/194,762

[22] PCT Filed: Jun. 19, 1997

[86] PCT No.: PCT/EP97/03208

§ 371 Date: Dec. 3, 1998

§ 102(e) Date: Dec. 3, 1998

[87] PCT Pub. No.: WO97/49315

PCT Pub. Date: Dec. 31, 1997

[30] Foreign Application Priority Data

Jun. 22, 1996 [DE] Germany ..... 196 24 962

[51] Int. Cl.[7] ..... A46B 7/04

[52] U.S. Cl. ..... 15/176.4; 15/167.1; 15/176.5

[58] Field of Search ..... 15/176.1, 176.4, 15/176.5, 176.6, 167.1, 145, 202, 194; D4/104

[56] References Cited

U.S. PATENT DOCUMENTS

| | | |
|---|---|---|
| 1,396,630 | 11/1921 | Higbee . |
| 1,717,125 | 6/1929 | Spitz . |
| 1,908,510 | 5/1933 | Dodson . |
| 3,008,165 | 11/1961 | Scholl . |
| 3,167,799 | 2/1965 | McKinley . |
| 4,543,679 | 10/1985 | Rosofsky . |
| 5,555,590 | 9/1996 | Blum et al. . |

FOREIGN PATENT DOCUMENTS

| | | | |
|---|---|---|---|
| 3038895 | 8/1982 | Germany | 15/176.4 |
| 3628 722 | 2/1988 | Germany . | |
| 37 24 640 | 2/1989 | Germany . | |
| 9408 268 | 7/1994 | Germany . | |
| 296 00 398 | 4/1996 | Germany . | |
| 44 34 617 | 4/1996 | Germany . | |

*Primary Examiner*—Gary K. Graham
*Attorney, Agent, or Firm*—Paul Vincent

[57] ABSTRACT

In the case of a dental care device e.g. a toothbrush, having a handle, a head and a care part insertable in locking manner in a depression thereof, said care part can be ejected by means of a resilient pressure piece located on the back of the head and which acts when pressure is exerted on the back of the care part. In order to provide a sealed termination on the back and an e.g. handling, the head has on the back an opening closed by the pressure piece and in which engages the care part and said pressure piece is constructed as a resilient plastic disk and is sealingly fixed with its circumferential edge on the wall of the opening.

11 Claims, 1 Drawing Sheet

DENTAL HYGIENE DEVICE WITH REPLACEABLE CLEANING PART

BACKGROUND OF THE INVENTION

The invention relates to a dental care or oral hygiene device with a handle, a head and a care part insertable in locking manner in a depression of the head and which by means of a resilient pressure piece on the back of the head acting by pressure action on the back of the care part can be ejected.

Dental care devices of the aforementioned type are particularly used as toothbrushes, so that hereinafter reference will only be made to the latter. However, they also cover devices which are exclusively used for massaging the gums or for caring for the interdental gaps.

Toothbrushes are required much more frequently than other types of brushes. The reason is the frequent use necessary for correct oral hygiene (up to three times daily) and the rapid wear resulting from this. In addition, Even in the case of relatively limited wear which would be acceptable with other brushes, a toothbrush has to be replaced, so as to always ensure an optimum effectiveness.

Due to the high toothbrush consumption, approximately 150 million per annum in Germany, there is an increasing problem of disposal and protecting resources, because the material fraction rendered unusable due to wear is extremely small compared with the total material and the total material to be disposed of, even in the case of a 100% recycling, cannot be processed to the same product, because the recycled material no longer fulfills the high quality requirements, which are vital e.g. for the bristle material of a toothbrush. Even if the known brushes with a replaceable brush part would fundamentally make it possible to only replace the brush part after wear, this problem has not hitherto been in the foreground and also in the case of standard brushes, such as cleaning brushes, body brushes, cosmetic brushes, etc. it is relatively unimportant, because the use period is much longer and the material ratio of unusable and still usable material is not in the same disproportion as with toothbrushes.

Finally, in connection with toothbrushes account must be taken of the special feature that they must be correctly usable by humans of all age classes and all education levels, so that the replacement of the brush part must be possible in a very simple manner and with limited force expenditure, whilst at the same time adequately securely joining the parts.

At present there are essentially two systems on the market. In the case of so-called replacement head brushes (EP 0 199 849 B1, DE 94 20 405 U1) the entire head with the bristles is detachably fixed to the handle. The locking fixing means are located on the handle substantially transversely to its longitudinal axis and on a shoulder of the head and are brought into engagement by the assembly of the head and handle in the longitudinal axial direction. Conversely the two parts can be detached by pulling apart in the longitudinal axial direction. These replacement head brushes are satisfactory from the use and hygienic standpoints. However, the plastics fraction of the head, which becomes waste when the bristles become worn, is still considerable. The further disadvantage arises that the fixing means are located in the transition area between head and handle, i.e. in an area where the greatest bending forces act during use. However, it is precisely in this area that the toothbrush is weakened by the constructional measures for the fixing means. This is particularly serious because, for use reasons, between the handle and the head it is desirable to have a slender and optionally resilient neck, which cannot be implemented with such replacement head brushes. Therefore replacement head brushes have already been proposed, in which the head is locked with the slender neck on the thicker handle. Thus, although the use advantage is substantially maintained, this is achieved at the cost of a larger amount of plastics waste. In addition, the risk also arises with all replacement head brushes, that in the case of incorrect locking or a failure of the locking system during use, serious injury can occur in the oral cavity.

With other known systems, to which belongs the toothbrush according to the preamble of claim 1, the bristles are fixed to a support in the form of a thin plate and said brush part is replaceably locked in the frame or casing-like head (DE 30 38 895, 37 24 640). The support is provided on its circumferential surface with ledge-like catches and the casing has corresponding channel-like depressions. On its back the support also has a pin, which engages in a hole in the bottom of the casing and forms on the back of the head an exposed pressure surface. The support is locked in the head and can be ejected by pressure on the pin. The plastics fraction to be replaced in the case of bristle wear is reduced to a minimum and the replaceable brush parts can be inexpensively manufactured due to the small amount of material used. However, hygienic and constructional problems arise as compared with replacement head brushes. In the gap necessarily present between the support and the casing cheek, which only dries inadequately, there is a deposition of dirt and accumulation of bacteria. This applies to a greater or lesser extent for the entire gap between head and support.

Thus, on its bristle side, the support is provided with an elastic, circumferential border (DE 37 24 640 C2), whose back sealingly engages against the front face of the casing cheek. This presupposes corresponding tensile forces drawing the support into the casing and consequently correspondingly high locking forces. In turn these make more difficult the insertion and ejection of the brush part. As locking takes place by self-closure, the locking means must be of a correspondingly large-volume nature, which requires considerable wall thicknesses on the head. Even more complicated is a construction (DE 296 00 398 U1), in which on all the sealing faces between the support and casing are provided elastic flat seals, which by a correspondingly high pretension simultaneously retain the brush part. The pretension must be completely absorbed by the casing cheek, which necessarily widens after a short time and a reliable hold of the brush part is no longer ensured.

Other proposals (DE 91 09 625 U1, DE 44 34 617 A1), which provide locking ledges in portionwise manner on the support circumference, lead to a corresponding reduction of the sealing of the gap, because the locking ledges and recesses are located in the sealing surfaces and very narrow tolerances must be respected, in order on the one hand to ensure a snug engagement of the sealing surfaces and on the other a reliable locking. It is scarcely possible to achieve such tolerances with injection moulded parts and the inexpensive plastics required for the head and handle. In addition, the casing cheek is constantly under elastic pretension due to the locking forces. Since plastics are not creep-resistant under tension (cold flow), there is a very rapid decrease to the tensional force of the casing cheek, so that the gap between cheek and support enlarges and the infiltration of dirt and bacteria is aided. As plastic fatigue and the resulting increase in the tolerances can scarcely be noticed by the user, he may only notice the failure of the locking means when cleaning the teeth. If the brush part is detached during use, it can once again lead to injury to the oral cavity and gingiva.

A very stable and durable connection of the brush part and head is brought in a known toothbrush (DE 41 04 314 A1) in that on the back of the support are shaped two mutually V-shaped ledges, which pass over the entire support length. They engage in a slot on the head opening outwards in V-shaped manner and which also passes over the entire length in its longitudinal axis. During insertion the ledges must be deformed inwards and towards one another to such an extent that they can pass through the narrowest cross-section of the V-shaped slot and then expand in said slot. Thus, the elastically deformed parts of the locking connection are located on the replacement part, where material fatigue is less important. The deformation forces on the ledges required for producing and detaching the locking connection are so high that the brush part can only be pressed or levered out with the aid of specially adapted tools. The need for such special tools not only leads to correspondingly high system costs for the consumer, but is prejudicial to a practical acceptance of the system by the market. This also applies because it is not possible to fulfil a requirement for avoiding injury, namely a smooth shape of the brush back. In addition, this toothbrush is also completely unacceptable for hygienic reasons, because the slot and ledges form several cracks, in which can be deposited dirt, toothpaste residues and bacteria. The same applies for another known construction (U.S. Pat. No. 4,543,679) with an expanding pin on the support, which engages in a V-shaped through hole on the back of the head.

In all the constructions with an exposed pin on the back as the pressure piece, the already described problem of the penetration of dirt and accumulation of bacteria arises. In addition, the back of the head is not smooth and gaps and depressions can become larger with increasing use times. The irregularities on the surface of the back can lead to mouth injuries.

The aforementioned disadvantages are largely removed in the already mentioned embodiment (DE 37 24 640 C2), in that the casing on the back is closed and the casing bottom wall thickness along a closed line is weakened in much the same way as a so-called film hinge, so that the bottom area within the weakening line is connected by means of a resilient connection to the remaining bottom area. The resulting pressure piece can be displaced when pressure is applied with the finger and can act directly on the support in order to eject the care part. This construction has the further advantage that the manufacturing tolerances for the locking means can be chosen narrowly without taking account of the pressure piece ejection function. However, it is disadvantageous that this construction necessarily only allows a small stroke or travel on the pressure piece. In addition, the head must be made from a relatively high-grade plastic, in order to ensure the spring characteristics for the pressure piece. In addition, fatigue fractures can easily occur in the area of the spring-like connection of pressure piece and bottom. As the spring articulation necessarily also requires gaps on the back of the head reducing the wall thickness, the hygienic requirements are also only inadequately fulfilled and here again injuries can occur in the oral cavity.

The problem of the invention is to so construct a dental care device of the last-mentioned construction, that the special hygienic requirements are fulfilled and the use characteristics improved.

SUMMARY OF THE INVENTION

According to the invention this problem is solved in that on the back of the head is provided an opening closed by the pressure piece and in which engages the care part and that the pressure piece is constructed as a flexible plastic disk and is sealingly engaged on the wall opening with its circumferential edge.

The construction according to the invention essentially comprises three parts, namely the head, which is optionally equipped with a handle, the care part inserted in a depression of the head and which at least partly engages in the head opening, and the separate pressure piece constructed as a flexible plastic disk and marginally sealingly fixed to the wall of the opening.

In this construction the manufacturing tolerances for the locking connection of care part and head are independent of the ejection function of the pressure piece. Therefore the design of the locking connection can be exclusively directed at the use function, namely locking and unlocking. The nature of the fitting of the pressure piece to the wall of the opening and the pressure piece material can exclusively be chosen with a view to the intended use. As the elasticity necessary for ejection is solely brought about through the design of the disk, the casing forming the head is subject to no weakening and the pressure piece travel can be functionally optimized. The opening in the head is hermetically sealed, so that a smooth surface is obtained. Moreover, outwardly open gaps with the resulting hygienic problems are avoided.

The pressure piece travel and its spring behaviour during ejection can be optimized from the use standpoint in such a way that the user sensitively or acoustically notices the function and said effects can optionally be assisted by a corresponding design of the locking connection separate from the pressure piece function.

Preferably, the care part has on its back located in the head depression a pin engaging into the opening up to the disk, the pin preferably being guided in the opening.

This leads to a clearance-free arrangement of the care part in the head and in particular facilitates the insertion of the care part into the head through the guidance of the pin. The pin on the care part and the opening on the head can be provided in an optimum position both for insertion and ejection.

Advantageously, the disk marginally terminates flush with the surface of the back on the head and is curved outwards towards its centre.

As a result of the convexity, it is possible to produce a "clicking effect" during the ejection process, which appropriately indicates the sought objective, namely the release of the care part from the head. The pressure piece can also be rendered sensitive for the blind.

The disk can be made from a different plastics material to the head, so that there is also a pressure piece function optimization from the material standpoint. Additionally the disk can be optically differentiated from the head, in order to render visible the function of the pressure piece.

Preferably the disk is made from an elastomer, which permanently ensures the pressure piece function and also offers a gripping effect during ejection, whilst finally preventing injuries in the oral cavity.

The disk can be positively or non-positively inserted in the head opening or can be moulded using an in-mould process during the injection moulding of the head.

BRIEF DESCRIPTION OF THE DRAWINGS

The invention is described in greater detail hereinafter relative to nonlimitative embodiments and the attached drawings, wherein show.

DESCRIPTION OF THE PREFERRED EMBODIMENT

Figure 1:
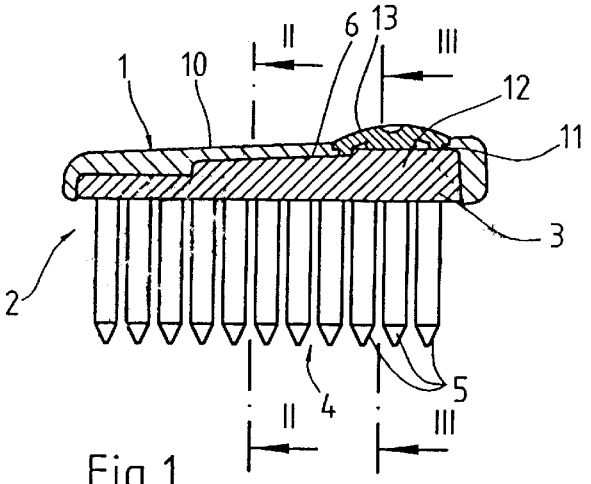
FIG. 1 A longitudinal section through the head of a broken away reproduced toothbrush.

The embodiments shown in the drawings relate to a dental care or oral hygiene device in the form of a toothbrush, whereof only the head 1 is shown. To the latter can be connected at the right-hand side in FIG. 1 a conventional handle, which is injection moulded in one piece together with the head 1. The dental care device has a replaceable care part 12, which in the represented embodiment comprises a plate-like plastic support 3 and a bristle facing 4 of a plurality of bundles 5, connected in known manner to the support 3. On its underside the head 1 has a trough-like depression 6, whose contour and outline correspond to those of the support 3.

The replaceable care part 2 or its support 3 is resiliently engaged in the depression 6 of the head 1 and can be replaced by releasing the locking connection. In the represented embodiment the locking connection is formed in that the support has on at least two facing sides (FIG. 3) individual projections 7 or ledge-like ribs, which correspond to corresponding depressions 8 on the side plates 9 of the head. The inner outline of the depression 6 in the head 1 and the outer outline of the carrier 3 are matched to one another with close tolerances, so that a snug seating of the care part in the head 1 is ensured.

The head 1 has on its back 10 a through opening 11, in which engages a pin 12 shaped onto the support 3 and which is guided in the opening 11.

In the area of the opening 11 is provided a pressure piece 13 in the form of an elastic disk 14, e.g. of elastomer, which closes the opening 11 on the back 10 of the head 1 and passes in flush manner into the surface of the back 10. The disk 14 is somewhat convex compared with the surface contour of the back 10 and has in its centre a finger trough 15.

The disk 14 engages on the pin 12 on support 3, so that when pressure is exerted on the disk 4 the compressive force is transferred to the pin 12 and the care part 4 can be ejected, accompanied by the release of the locking connections 7, 8.

Figure 2:
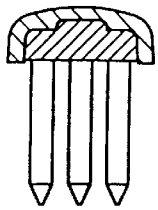
FIG. 2 A section II—II of FIG. 1.
Figure 3:
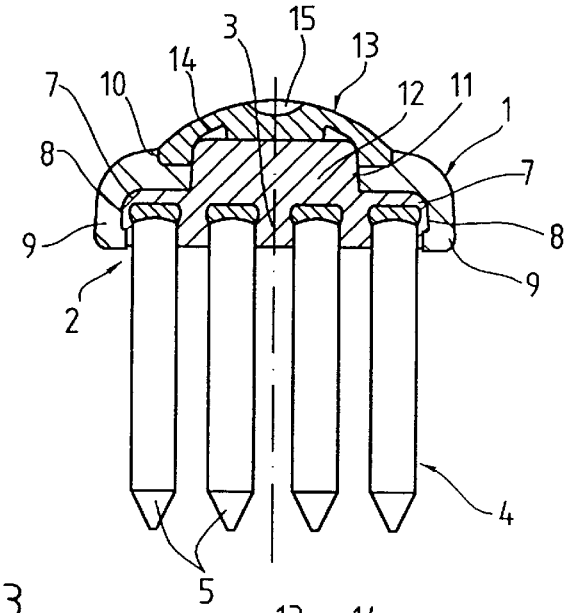
FIG. 3 A section III—III of FIG. 1.

In the embodiment shown in FIGS. 1 to 3 the disk 14 is, during the injection moulding of the head 1, sealingly and non-positively connected thereto or also bonded in using the in-mould process.

Figure 4:
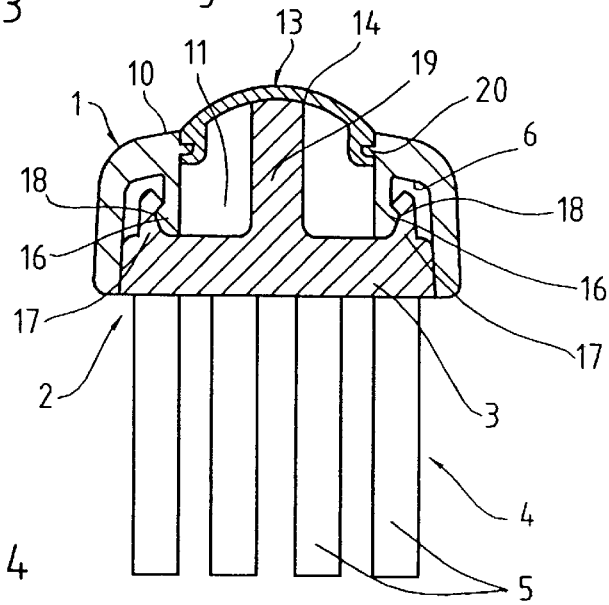
FIG. 4 A section of another embodiment of the toothbrush head corresponding to FIG. 3.

In the embodiment according to FIG. 4 the depression 6 on the head 1 and the support 3 of the replaceable care part 2 have a different construction. As in the embodiment according to FIGS. 1 to 3, the head 1has an opening 11, but whose wall is drawn into the depression 6 and has on its free ends thickened portions 16, which cooperate with spring catches 17 on the back of the support 3. To this end the spring catches 17 have on their inside recesses 18 adapted to the thickened portions 16. It is naturally conversely possible to resiliently construct the inwardly projecting wall in the form of individually standing wall portions.

In this embodiment the support 3 also has a pin 19 which, unlike in FIGS. 1 to 3, is not guided in the opening 11. The pressure piece 13 is again in the form of a disk 14, which spans the opening 11, but in this case is marginally fixed to projections 20 on the inner wall of the opening 11. The disk 14 can be mechanically inserted or once again connected in the in-mould process to the head 1. Welding or bonding in are also possible for fixing the disk 14.

The ejection of the worn care part 2 takes place in the same way by exerting pressure on the disk 14, which is transferred to the pin 19 and leads to the release of the locking connections 16, 17, 18.

What is claimed is:

1. Dental care device comprising:

a head having a recess and an opening in a back portion thereof defined by a wall;

a care member for locked insertion into said recess; and a resilient plastic disk having a peripheral edge fixed for sealing at said wall to close said opening, said disk engaging said care member to eject said care member when pressure is exerted on an outer side of said disk.

2. The device of claim 1, wherein said care member has a pin disposed within said recess of said head, engaging into said opening, and extending up to said disk.

3. The device of claim 2, wherein said pin is guided in said opening.

4. The device of claim 1, wherein said disk joins substantially flush with a back surface of said head and is outwardly curved towards a center thereof.

5. The device of claim 1, wherein said disk is made from a material which is different than a material from which said head is made.

6. The device of claim 5, wherein said disk is made from an elastomer.

7. The device of claim 5, wherein said disk is optically differentiated from said head.

8. The device of claim 1, wherein said disk is inserted into said opening in positive engagement therewith.

9. The device of claim 1, wherein said disk is inserted into said opening in non-positive engagement therewith.

10. The device of claim 1, wherein said disk is inserted into said opening in even material engagement therewith.

11. The device of claim 1, wherein said disk is moulded in an in-mould process during injection moulding of said head.

* * * * *